US005984989A

United States Patent [19]

Davison et al.

[11] Patent Number: 5,984,989

[45] **Date of Patent: *Nov. 16, 1999**

[54] COATED ABRASIVES AND BACKING THEREFOR

[75] Inventors: Nigel Davison, Burton-on-Trent; Andrew J. Ball, Stenson Fields, both of United Kingdom

[73] Assignee: 3M Innovative Properties Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/803,907

[22] Filed: Feb. 21, 1997

[30] Foreign Application Priority Data

Mar. 7, 1996 [GB] United Kingdom ..... 9604855

[51] Int. Cl.[6] ..... C09K 3/14; C08J 5/14; B24D 3/20; B24D 3/28; B24D 3/34; B24D 11/00; B24D 11/02

[52] U.S. Cl. ..... 51/298; 51/303; 51/307; 51/308; 51/309; 156/244.11; 156/244.24; 156/305; 264/174.11; 427/180; 427/201; 427/202; 427/204; 427/205; 427/326; 427/391; 427/411; 428/219; 428/340; 428/341; 428/342; 428/441; 428/442; 428/451; 428/481; 428/507; 428/511; 428/512; 428/513; 428/514; 428/537.5

[58] Field of Search ..... 427/180, 201, 427/202, 204, 205, 326, 391, 411; 428/441, 340, 442, 341, 451, 342, 481, 219, 507, 511, 512, 513, 514, 537.5; 264/174.11; 51/298, 303, 307, 308, 309; 156/244.11, 244.24, 305

[56] References Cited

U.S. PATENT DOCUMENTS

| | | | |
|---|---|---|---|
| 1,910,444 | 5/1933 | Nicholson | 51/308 |
| 2,712,987 | 7/1955 | Storrs et al. | 51/293 |
| 3,041,156 | 6/1962 | Rowse et al. | 51/298 |
| 3,230,672 | 1/1966 | Anthon | 51/404 |
| 3,849,849 | 11/1974 | Gottlieb | 28/72.5 |
| 4,240,807 | 12/1980 | Kronzer | 51/295 |
| 4,606,154 | 8/1986 | Herrmann et al. | 51/401 |
| 4,609,581 | 9/1986 | Ott | 428/100 |
| 4,773,920 | 9/1988 | Chasman et al. | 51/295 |
| 4,997,461 | 3/1991 | Markhoff-Matheny et al. | 51/295 |
| 5,009,675 | 4/1991 | Kunz et al. | 51/295 |
| 5,011,508 | 4/1991 | Wald et al. | 51/293 |
| 5,042,991 | 8/1991 | Kunz et al | 51/295 |
| 5,085,671 | 2/1992 | Martin et al. | 51/293 |
| 5,152,917 | 10/1992 | Pieper et al. | 51/295 |
| 5,213,951 | 5/1993 | Delfino | 430/504 |
| 5,254,194 | 10/1993 | Ott | 156/176 |
| 5,435,816 | 7/1995 | Spurgeon et al. | 51/295 |
| 5,436,063 | 7/1995 | Follett et al. | 428/224 |
| 5,611,825 | 3/1997 | Engen et al. | 51/295 |

FOREIGN PATENT DOCUMENTS

| | | |
|---|---|---|
| 0 237 784 A1 | 9/1987 | European Pat. Off. . |
| 0 587 171 A1 | 3/1994 | European Pat. Off. . |
| 0 638 392 A1 | 2/1995 | European Pat. Off. . |
| 32 02 260 | 8/1983 | Germany . |
| 1 451 331 | 9/1976 | United Kingdom . |
| WO 94/06839 | 3/1994 | WIPO . |
| WO 95/03156 | 2/1995 | WIPO . |
| WO 95/11111 | 4/1995 | WIPO . |
| WO 95/19242 | 7/1995 | WIPO . |
| WO 96/09141 | 3/1996 | WIPO . |

OTHER PUBLICATIONS

R.H. Cramm, "Extrusion Coating," in *Pulp and Paper: Chemistry and Chemical Technology*, J.P. Casey editor vol. IV, 3rd rd edition, Wiley–Interscience, N.Y., pp. 2501–2532 (1983).

*Primary Examiner*—Rabon Sergent
*Attorney, Agent, or Firm*—Scott A. Bardell; Doreen S. Gwin

[57] ABSTRACT

A coated abrasive sheet material comprising (a) a backing substrate having at least one major surface, (b) a plurality of abrasive grains, (c) a binder bonding said plurality of abrasive grains to said at least one major surface of the backing substrate, wherein the backing substrate comprises paper having a basis weight of less than about 200 g/m$^2$ which is essentially free of latex saturants and has on said at least one major surface with the plurality of abrasive grains, one or more extruded layers of a thermoplastic polymer, and a method of making the coated abrasive sheet material.

23 Claims, No Drawings

COATED ABRASIVES AND BACKING THEREFOR

This invention relates to coated abrasives and to a backing for coated abrasives comprising paper of low basis weight bearing on at least one side an extruded polymer coating.

Paper is probably the most commonly used backing material for coated abrasive sheet materials, largely because of its relatively low cost, its availability in a variety of thicknesses and strengths, and its amenability to chemical treatments which modify its physical and chemical properties. Nevertheless, there is a continuing interest in developing backing materials with improved physical properties and/or lower raw material costs.

A particular problem shown by conventional paper based abrasive sheets especially those of a lighter weight is that of "shelling", or loss of mineral, when the sheet is folded over on itself or wrapped round a curve of narrow radius. In extreme cases, sizable portions of the coating (mineral plus binder) may flake off. The problem is believed to stem from non-uniform tensile stresses through the abrasive/paper laminate allowing cracks through the abrasive layer to propagate along the resin/paper interface, resulting in the coating flaking off via delamination from the paper surface. The problem may be alleviated by use of a flexible make adhesive instead of a urea-formaldehyde make resin, which is more brittle. However, this adds considerably to the cost of the product.

U.S. Pat. No. 4606154 discusses the problem of adhering abrasive grains to an extensible substrate, and proposes, as a solution, the use of a textile substrate and an elastic (rubbery) intermediate layer between the substrate and a conventional coating of abrasive mineral.

When "untreated" paper is used as the backing for coated abrasive sheets, a basis weight of at least 200 g/m$^2$is generally required for adequate strength and durability; cylinder paper of 250 to 300 g/m$^2$ basis weight being typical. "Untreated" in this context refers to paper which has not been subjected to chemical treatments (especially coating or saturation with resins) subsequent to its manufacture in a dry state. Treatment of papers by coating or saturation with resins is generally carried out in order to confer waterproof or oilproof properties on the paper, but may also increase its tensile strength and durability. Thus, abrasive sheets intended for wet sanding frequently comprise a backing of latex-saturated paper with a basis weight of much less than 200 g/m$^2$. However, the use of a latex saturant adds considerably to the manufacturing costs, both in terms of raw materials and the energy required to dry or cure the latex. Furthermore, the latex saturant may be incompatible with many of the commonly used make and size resins as described in EP-A-0237784.

The use, as backing materials for coated abrasives, of composites comprising a layer of paper and a layer of polymer film is disclosed in GB-A-1451331. This patent discloses an abrasive sheet having a backing comprising a laminate of at least one fibrous sheet, normally paper, and a dimensionally stable preformed sheet of plastics material, said one sheet of fibrous material being exposed at one face of the laminate, and a cured adhesive bonded to the opposite surface of the laminate, abrasive grains being embedded in the adhesive. Although coating of the abrasive directly on the plastics material is said to be possible, this is discouraged, and preferred embodiments comprise a second fibrous sheet between the plastics material and the abrasive. Bonding between the paper and plastics layers is by means of an adhesive, and the stated advantage is an improvement in dimensional stability.

EP-A-0237784 discloses a substrate for supporting an abrasive grit adhesive top coat, the substrate comprising a latex-treated backing sheet and a layer of neutral barrier material disposed on top of the backing sheet, the neutral barrier material being adapted for adhering the top coat to the backing sheet while separating the backing sheet and top coat to permit the curing of the top coat without interference from the backing sheet and the neutral barrier material. In preferred embodiments, the neutral barrier material takes the form of an extruded layer of polymeric material such as polyethylene or similar materials. The latex-treated backing sheet is described as a latex-treated or saturated base paper, typically comprising 15 to 100 parts solid saturant per 100 parts paper. The purpose of the barrier material is to prevent interaction of the latex saturant with the adhesive used to secure the abrasive grit.

EP-A-0587171 discloses a coated abrasive material having a flexible backing member comprising, in combination, a flexible paper bottom member having top and bottom surfaces and a polymer film layer adhered to the top surface of the bottom member and a make coat adhered to the surface of the film layer component of the backing member, the make coat having abrasive grains secured thereto, the peel adhesion between the film layer and the make coat adhering thereto being greater than the ply adhesion strength of the paper bottom member. The stated advantages are a smoother surface for the backing member (useful in the case of fine-grade abrasives), and a reduced tendency for edge-chipping when discs of the abrasive material are used for the grinding of automobile body seams. The paper component of the backing member is described as any paper now conventionally used as a backing member in coated abrasive material, and 288 g/m$^2$ cylinder paper is exemplified. The preferred polymer film is an ionomer such as the zinc salt of an ethylene/acrylic acid copolymer, although other materials such as chemically modified polyolefins and polyamides are also said to be useful.

The above mentioned references teach treating the paper or laminating a paper to another substrate. In general the known treating and/or laminating steps add cost to the base paper, both in terms of the raw materials and processing.

What is desired in the abrasive industry is a low cost paper that still exhibits the appropriate characteristics necessary for a coated abrasive backing.

The present invention provides a coated abrasive sheet material comprising:

(a) a backing substrate having at least one major surface, (b) a plurality of abrasive grains, (c) a binder bonding said plurality of abrasive grains to said at least one major surface of the backing substrate, wherein the backing substrate comprises paper having a basis weight of less than about 200 g/m$^2$ which is essentially free of latex saturants and has on said at least one major surface with the plurality of abrasive grains, one or more extruded layers of a thermoplastic polymer.

The invention enables the use of cheap, lightweight papers to be used as a backing substrate for coated abrasive sheet materials. In absence of the extruded polymer coatings, such low cost lightweight papers would generally have insufficient physical properties for use as an effective backing for flexible, delamination resistant coated abrasives. Even with the added cost of the extruded polymer coating, the net cost of the composite backing substrate used in the invention may be considerably less than the cost of conventional backing paper.

The paper used in the backing substrate in the abrasive materials of the invention has a basis weight of less than 200 $g/m^2$ and is generally less than 150 $g/m^2$, preferably less than 120 $g/m^2$ and may be as low as 50 $g/m^2$. The paper does not require the presence of latex saturants and is essentially free from latex saturants. "Essentially free of latex saturants" means that the paper contains no more than 5% by weight of latex saturants. Generally the paper contains less than 3% by weight of latex saturants and preferably is free from latex saturants. Similarly, it is preferred that the paper is essentially free, more preferably free, of any adhesive type saturants. An example of a suitable paper is "Swan White X" commercially available from Wisa Forest (UK) Limited.

In addition to these cost savings, by suitable selection of the thermoplastic polymer and processing conditions, it is possible to produce abrasive sheet materials having markedly improved performance compared to conventional paper backed products. One significant advantage is improved flexibility resistance to cracking and delamination when the sheet is folded or forced to conform to a curve of narrow radius believed to be achieved by absorption of crack propagation energy by the thermoplastic layer. Other advantages may be manifested in terms of durability, working life and cut performance. Furthermore, these advantages are retained even when a low-cost brittle urea-formaldehyde resin is used as the make adhesive.

A wide range of thermoplastic polymers may be extruded on the paper. Examples of such polymers include low density polyethylene, ethylene butyl acrylate copolymers, ethylene methyl acrylate copolymers, ethylene acrylic acid copolymers, polyurethanes, polyamides and polyesters and the like and combinations thereof. A preferred polymer for use in the invention is ethylene butyl acrylate polymer. The coating weight of the extruded polymer layer(s) is generally in the range 5 to 50 $g/m^2$, preferably 20 to 35 $g/m^2$, more preferably 25 to 30 $g/m^2$. The thermoplastic polymer may be extruded as a single layer or two or more layers of thermoplastic polymer may be co-extruded on the paper. Polymers such as low density polyethylene are relatively cheap and may be extruded directly on to the paper and overcoated with a layer of more expensive thermoplastic polymer, such as ethylene/butyl acrylate copolymer. This reduces the cost of the thermoplastic polymers while retaining the desirable properties of ethylene/butyl acrylate copolymer.

Suitable extrusion coating techniques are disclosed in R. H. Cramm, "Extrusion Coating", in *Pulp and Paper: Chemistry and Chemical Technology*, J. P. Casey editor, Vol. IV, 3rd edition, Wiley-Interscience, N.Y., 1983, pp. 2501–2532 incorporated herein by reference. One method of application is an extrusion coating process wherein a hot molten film of the barrier coating material is brought into contact with the backing sheet and the combination is then placed under pressure through the use of nip rollers. Coextrusion is another method in which a multilayered coating having component sublayers is prepared at a single coating station by combining the polymer flows from two or more extruders. Resin blending does not occur. Instead, distinct component sublayers are formed which are in intimate contact with one another.

It has been found that the bonding properties between the thermoplastic polymer and the binder of the abrasive layer and the thermoplastic and the backing paper may be improved if the abrasive sheet is heated to a temperature above the softening point of the thermoplastic polymer during the manufacturing process. Preferably the material is heated above the softening point of the polymer for at least 5 minutes, generally, 15 to 30 minutes.

The thermoplastic layer may also contain various additives to modify the physical properties of the layer or to reduce its cost. Examples of these additives include fillers, dyes, pigments, plasticisers, anti-static agents, wetting agents, coupling agents, processing aids and the like.

Apart from the construction of the backing substrate, the construction of the abrasive sheet material of the invention may adopt conventional techniques and materials. Any of the known methods of coating abrasive material may be used, such as slurry coating, electro-coating, drop coating etc.

The coated abrasive typically comprises a backing having a first binder layer. This first binder layer is commonly referred to as a make coat and bonds the abrasive grains to the backing. Over the abrasive grains is a second binder layer. This second binder layer is commonly referred to as a size coat and reinforces the abrasive grains. Optionally, a third binder layer often referred to as a supersize, may be present over the second binder layer. The abrasive coating may comprise any mixture of different sizes and types of abrasive grains. The abrasive coating may be in the form of a uniform layer or coated pattern-wise on the substrate.

A wide range of known make and size resins may be employed including radiation cured resin systems and hot melt resin systems. Non-limiting examples of suitable resins include phenolic resins, epoxy resins, urea-formaldehyde resins, acrylate resins, urethane resins and ethylenically unsaturated resins and combinations thereof. Examples of suitable urea-formaldehyde resin compositions are disclosed in WO94/06839 and PCT/US95/09667 which are both incorporated herein by reference. Suitable hot melt resins are disclosed in U.S. Pat. No. 5,436,063, WO95/11111 and EP-A-0638392, all of which are incorporated herein by reference.

The make and size coatings may contain other materials that are commonly utilised in abrasive articles. These materials, referred to as additives, include fillers, grinding aids, coupling agents, anti-static agents, wetting agents, lubricating agents, dyes, pigments, plasticisers, release agents, or combinations thereof. Fillers might also be used as additives in the first and second binder layers. For both economy and advantageous results, fillers are typically present in no more than an amount of about 50% for the make coating or about 70% for the size coating, based upon the weight of the adhesive. In many cases, a lower coating weight of the make adhesive used to secure the abrasive grains to the backing may be used compared with abrasive sheets made on conventional paper backing, owing to the impermeability of the extruded polymer film. The invention also allows the use of low cost, brittle resins to substitute the more expensive flexible resins. This represents a further saving in raw materials and energy.

The abrasive articles described above can contain 100% of a single abrasive grain. Alternatively, the abrasive article may comprise a blend or mixture of different abrasive grains. The mineral may be coated from 30% to 100%, preferably 50% to 100% to form either open or closed coat construction. These conventional abrasive grains include fused aluminum oxide, heat treated aluminum oxide, white fused aluminum oxide, silica, silicon carbide, titanium diboride, boron carbide, tungsten carbide, titanium carbide, diamond, cubic boron nitride, garnet, fused alumina zirconia, other sol gel abrasive grains and the like. The diamond and cubic boron nitride abrasive grains may be monocrystalline or polycrystalline. The particle size of these conventional abrasive grains can range from about 0.01 to 1500 micrometers, typically between 1 to 1000 micrometers.

The abrasive grains may also contain an organic or inorganic coating. Such surface coatings are described, for example, in U.S. Pat. Nos. 5,011,508, 1,910,444, 3,041,156, 5,009,675, 4,997,461, 5,213,951, 5,085,671 and 5,042,991, all of which are incorporated herein by reference.

The coated abrasive may contain a supersize coating which prevents the coated abrasive from "loading". "Loading" is the term used to describe the filling of spaces between abrasive grains with swarf (the material abraded from the workpiece) and the subsequent build-up of that material. For example, during wood sanding, swarf comprised of wood particles becomes lodged in the spaces between abrasive grains, dramatically reducing the cutting ability of the abrasive grains. Examples of such loading resistant materials include metal salts of fatty acids, e.g. zinc stearate, calcium stearate, lithium stearate, urea-formaldehyde, waxes, mineral oils, crosslinked silanes, crosslinked silicones, fluorochemicals and combinations thereof. The abrasive materials may be constructed in a variety of shapes and forms e.g. belts, discs, sheets, tapes, daisies and the like. A plurality of discs may be converted to a disc roll as disclosed in U.S. Pat. No. 3,849,849, incorporated herein by reference.

In one embodiment a pressure sensitive adhesive is coated onto the back side of the coated abrasive such that the resulting coated abrasive can be secured to a back up pad. In another embodiment the coated abrasive may contain a hook and loop type attachment system to secure the coated abrasive to the back up pad. The loop fabric may be on the back side of the coated abrasive with hooks on the back up pad. Alternatively, the hooks may be on the back side of the coated abrasive with the loops on the back up pad. This hook and loop type attachment system is further described in U.S. Pat. Nos. 4,609,581 and 5,254,194 and WO95/19242, all of which are incorporated herein by reference.

In some instances, it is preferred to incorporate a pressure sensitive adhesive onto the back side of the coated abrasive such that the resulting coated abrasive can be secured to a back up pad. Representative examples of pressure sensitive adhesives suitable for this invention include latex crepe, rosin, acrylic polymers and copolymers e.g. polybutylacrylate, polyacrylate ester, vinyl ethers, e.g. polyvinyl n-butyl ether, alkyd adhesives, rubber adhesives, e.g., natural rubber, synthetic rubber, chlorinated rubber, and mixtures thereof. The preferred pressure sensitive adhesive is an isoocrylacrylate:acrylic acid copolymer.

The sheet material of the invention may be in the form of a lapping coated abrasive article. A lapping coated abrasive article comprises a backing having an abrasive coating bonded to the backing. The abrasive coating comprises a mixture of abrasive grains distributed in a binder. In some instances, the binder bonds this abrasive coating to the backing. Typically, the particle size of these abrasive grains is on average less than about 200 micrometers. The abrasive coating may be textured or patterned. The abrasive coating may also further comprise additives that are discussed below.

The sheet material of the invention may be in the form of a structured abrasive article. A structured abrasive article comprises a backing having a plurality of precisely shaped abrasive composites bonded to the backing. These abrasive composites comprises a mixture of abrasive grains distributed in a binder. In some instances, the binder bonds the abrasive composites to the backing. Typically, the particle size of these abrasive grains is on average less than about 200 micrometers. The abrasive coating may have a patterned or textured outer surface. These abrasive composites may also further comprise additives that are discussed below. An additional advantage of the invention is that dyes and/or pigments may readily be incorporated into the thermoplastic polymer extruded on the paper. Thus, it is possible to produce a range of backing substrates of different colours, e.g., as a code for different grades of abrasive and use the same coating apparatus for colourless make or size resins for producing different coloured coated abrasive sheet materials without necessitating the cleaning of the coating apparatus which would be required when preparing coloured materials by incorporating pigment in the make or size resins.

The sheet materials of the invention may be prepared by coating techniques known in the art. For example, an abrasive material comprising make, size and supersize coats may be prepared as follows in which references to coating precursors refer to the coating compositions prior to curing.

The make coat precursor is applied over the extrusion coated paper by any conventional technique such as spray coating, roll coating, die coating, powder coating, transfer coating, hot melt coating or knife coating. The abrasive grains are projected into the make coat precursor, before the drying or partial curing. Typically the abrasive grains are projected by an electrostatic coating process. Then the size coat precursor is applied over the abrasive grains by any conventional technique. Finally, the supersize coat precursor is applied over the size coat by any conventional technique.

The extrusion coated backing paper may also be incorporated into a structured abrasive article or a lapping coated abrasive article.

Methods of making a coated abrasive are described in U.S. Pat. No. 5,152,917 and 5,435,816, both of which are incorporated herein after by reference. One method involves 1) introducing the abrasive slurry onto a production tool, wherein the production tool has a specified pattern, 2) introducing a backing to the outer surface of the production tool such that the slurry wets one major surface of the backing to form an intermediate article, 3) at least partially curing or gelling the resinous adhesive before the intermediate article departs from the outer surface of the production tool to form a coated abrasive article, and 4) removing the coated abrasive article from the production tool. Another method involves 1) introducing the abrasive slurry onto the backing such that the slurry wets the front side of the backing to form an intermediate article, 2) introducing the intermediate article to a production tool having a specified pattern, 3) at least partially curing or gelling the resinous adhesive before the intermediate article departs from the outer surface of the production tool to form a coated abrasive article, and 4) removing the coated abrasive article from the production tool. If the production tool is made from a transparent material, e.g. a polypropylene or polyethylene thermoplastic, then either visible or ultraviolet light can be transmitted through the production tool and into the abrasive slurry to cure the resinous adhesive. In these two methods, the resulting solidified abrasive slurry or abrasive composite will have the inverse pattern of the production tool. By at least partially curing or solidifying on the production tool, the abrasive composite has a precise and predetermined pattern. The resinous adhesive can be further solidified or cured off the production tool.

For a lapping coated abrasive, the abrasive slurry is coated onto at least one side of a backing. This coating can be accomplished by spraying, rotogravure coating, roll coating, dip coating or knife coating. After the coating process, the resinous adhesive is solidified by the exposure to an energy source. These energy sources can include thermal and radiation energy (e.g. electron beam, ultraviolet light and visible light). A method of preparing a lapping coated abrasive is also disclosed in U.S. Pat. No. 4,773,920 incorporated herein by reference.

The invention will now be illustrated by the following Examples in which the following abbreviations are used:

| | |
|---|---|
| BLMFX - | bleached, double calendered paper commercially available under the trade name "Swan White X" from Wisa Forest (UK) Limited |
| LDPE - | low density polyethylene having a melt index in the range 2–16 |
| EBA - | ethylene/butyl acrylate copolymer of about 17% acrylate content |
| EMA - | ethylene/methyl acrylate copolymer of about 17% acrylate content |
| EAA - | ethylene/acrylic acid copolymer of about 17% acrylate content |
| Surlyn - | a trade designation for an ionomer resin which is a zinc salt of ethylene/acrylic acid copolymer, commercially available from E.I. DuPont Company, Wilmington D.E. |

EXAMPLE 1

Samples of coated abrasive sheets were prepared using P80 or 180 grade fused aluminium oxide abrasive particles. The formulations of the make and size in parts by weight were as follows:

| Make Formulation | P180 | P80 |
|---|---|---|
| Urea-Formaldehyde resin | 1.1 | 0.44 |
| Vinyl acetate/vinyl chloride/ethylene copolymer | 1.0 | 0 |
| Acrylonitrile/acrylic ester copolymer latex | 0 | 1.0 |
| Ammonium chloride/hexamine resin hardener | 0.11 | 0.04 |
| Size (both mineral grades) | | |
| Urea-Formaldehyde resin | 1.0 | |
| Vinyl acetate/vinyl chloride/ethylene copolymer | 0.33 | |
| Ammonium chloride/hexamine resin hardener | 0.1 | |

After roll coating the make and electrostatically coating abrasive particles the sheet was cured at 66° C. for 14 minutes.

After application of the size the coating was cured by raising the temperature to 65° C. and maintaining that temperature for about 1hour.

The samples prepared are reported in the following Table in which 120 BLMFX/10LDPE/15EBA denotes 120 g/m$^2$ paper having extruded layer of 10 g/m$^2$ low density polyethylene and 15 g/m$^2$ ethylene butyl acrylate copolymer and the remaining backings use similar notation.

The paper was corona treated before application of the extruded layer.

| Sample | Mineral Grade | Backing | Nominal Make wt. (g/m$^2$) | Nominal Make wt. (g/m$^2$) | Nominal Size wt. (g/m$^2$) |
|---|---|---|---|---|---|
| 1 | P80 | 120 BLMFX/ 10LDPE/15EBA | 18 | 125 | 130 |
| 2 | P80 | 120 BLMFX/ 15Surlyn | 18 | 125 | 130 |
| 3 | P80 | Arjo-Wiggins R7* abrasive backing (comparative) | 18 | 125 | 130 |
| 4 | P180 | 120 BLMFX/ 15EBA | 6 | 51 | 61 |
| 5 | P180 | Arjo-Wiggins AL71* abrasive backing (comparative) | 25 | 80 | 60 |

*commercially available from Arjo-Wiggins S.A.

Samples 1 and 2 exhibited improved flexibility and delamination resistance compared with Sample 3 which did not possess an extruded polymer film, with Sample 1superior to Sample 2. Delamination resistance was assessed as the resistance to flaking when the sheet was folded or bent to a tight curve.

Sample 4 exhibited greatly improved flexibility and delamination resistance compared with Sample 5 which is representative of commercially available coated abrasive.

Further trials were conducted using mineral grades P80 and P180 and the above make and size formulations as follows:

| Sample | Mineral Grade | Backing | Nominal Make wt. (g/m$^2$) | Nominal Make wt. (g/m$^2$) | Nominal Size wt. (g/m$^2$) |
|---|---|---|---|---|---|
| 6 | P80 | 150 BLMFX/ 15 LDPE/15 EBA | 18 | 125 | 130 |
| 7 | P180 | 120 BLMFX/ 15 LDPE/15 EBA | 7 | 68 | 58 |

All samples coated easily on a standard abrasive coating line and were overcoated with a supersize comprising:

81.3% "Nopco 1097A" commercially available from Henkel Chemicals Limited, Leeds, England, 16.3%, "Vinacryl 71322" commercially available from Vinamul Limited, Carshalton, Surrey England, 0.8% "FC 396" commercially available from 3M United Kingdom plc, and 1.6% water.

The supersize was coated to provide 28 g/m$^2$ dry coated weight and cured above 100° C. for several seconds.

The samples were compared for cut performance on wood and for delamination resistance, against the commercial product "3M 235U" available from 3M United Kingdom plc which has the benefit of a flexible make adhesive. Cut performance was assessed by weighing the oak removed from 10 sticks abraded by sample abrasive products at about 170 KPa applied pressure. Each stick was abraded for 10 seconds, the abrasive being rotated at 850 rpm. The abrasive sanded the oak with the grain.

The support for the abrasive was a back-up pad of phenolic resin rated about 89 on a Barcol hardness.

Sample 7 of P180 exhibited equivalent delamination resistance and cut performance as compared to the "3M 235U" product thereby demonstrating the invention may employ a brittle make coating to achieve comparable properties to the "3M 235U". Sample 6 of P80 exhibited some delamination of the abrasive demonstrating the effect of increasing the thickness of the brittle abrasive layer. Nevertheless the cut performance of the P80 was still 100% of the "3M 235U" commercial product confirming that the polymer coating had no detrimental effect on the cut performance.

EXAMPLE 2

Samples were prepared using P80 mineral and the make and size formulations of Example 1. The following backing substrates were used.

| Sample | Backing |
|---|---|
| 8 and 11 | 120 BLMFX/5 LDPE/20 EBA |
| 9 and 12 | 120 BLMFX/5 LDPE/30 EBA |
| 10 and 13 | 120 BLMFX/25 EBA |

Different curing conditions were also evaluated. One set of samples (Samples 8 to 10) were cured at 70° C. for 12 minutes and an identical set of samples (Samples 11 to 13) were cured at 105° C. for 30 minutes.

Tests on the samples revealed that Samples 8 to 10, cured at 70° C. delaminated relatively easily. By contrast Samples 11 to 13 cured at 105° C. showed no delamination of the coat, eventual failure was caused by internal delamination of the paper.

It was theorised that heating the laminate above the softening point of the polymer layer significantly improved the bonding between the polymer and make coat and possibly the polymer and backing paper. In order to demonstrate this, Samples 8 to 10 which had been cured at 70° C. were heated in an oven at 120° C. for 15 minutes. After cooling the Samples were re-tested for delamination resistance and it was found that in all cases there was a significant improvement. In fact all of the Samples 8 to 10 after heating at 120° C. had a similar flexibility and delamination resistance to Samples 11 to 13 cured at 105° C. with failure occurring via delamination of the backing paper. Thus it was concluded that in order to improve the properties the abrasive product is preferably heated above the softening point of the polymer layer e.g. for several minutes during the manufacturing process to ensure good bonding of the polymer to the make adhesive and to the paper.

Further evidence for this was found by an experiment on the coated paper backing itself.

A Sample of 120 BLMFX/30 EBA extruded coated paper (Sample 14) was examined and it was found that the polymer layer could be peeled from the paper with little or no delamination of the paper itself. After heating to 105° C. for 15 minutes the surface of the polymer changed from a matt to glossy appearance and it could not be peeled away from the paper without significant delamination of the paper indicating an improvement of the paper thermoplastic resin bond.

EXAMPLE 3

Additional experiments were conducted on a P80 mineral grade brown aluminium oxide coated abrasive (Sample 15) using 120BLMFX/30EBA backing. The make and size formulations in parts by weight were as follows:

| | Parts by Wt. |
|---|---|
| Make | |
| Urea-Formaldehyde resin | 1.1 |
| Vinyl acetate/vinyl chloride/ethylene copolymer | 1.0 |
| Ammonium chloride/hexamine resin hardener | 0.11 |
| Size | |
| urea-Formaldehyde resin | 3.0 |
| Vinyl acetate/vinyl chloride/ethylene copolymer | 1.0 |
| Ammonium chloride/hexamine resin hardener | 0.3 |

The coating weights were as follows:

| Make wt. ($g/m^2$) | Mineral wt. ($g/m^2$) | Size wt. ($g/m^2$) |
|---|---|---|
| 20 | 102 | 113 |

After the make coating was applied to the backing the abrasive particles were electrostatically coated and the resulting construction cured at a temperature of 105° C. and held at that temperature for about 30 minutes.

The size coating was cured by gradually raising the temperature to 75° C. and maintaining that temperature for about 30 minutes. A supersize coating was applied as in Samples 7 and 8.

Sample 15 was coated using the equipment and conditions routinely used for the manufacture of conventional paper-backed abrasive products with no apparent problems.

Flexibility and delamination resistance were excellent, delamination occurring by failure within the paper. The cut performance of the Sample 15 was assessed as in Example 1 and found to be 270% of the commercially available "3M 235U" product.

EXAMPLE 4

Samples were prepared using the following backing substrates:

| Sample | Backing |
|---|---|
| 16 | 120 BLMFX/10 LDPE/15 EMA |
| 17 | 120 BLMFX/20 LDPE/10 EAA |
| 18 | 120 BLMFX |

The following make and size formulations, in parts by weight, were used:

| | Parts by Wt. |
|---|---|
| Make | |
| Urea-Formaldehyde resin | 1.1 |
| Vinyl acetate/vinyl chloride/ethylene copolymer | 1.0 |
| Ammonium chloride/hexamine resin hardener | 0.11 |
| Size | |
| Urea-Formaldehyde resin | 3.0 |
| Vinyl acetate/vinyl chloride/ethylene copolymer | 1.0 |
| Ammonium chloride/hexamine resin hardener | 0.3 |

The coating weights were as follows:

| Make wt. ($g/m^2$) | Mineral (P80) wt. ($g/m^2$) | Size wt. ($g/m^2$) |
|---|---|---|
| 30 | 85 | 65 |

Curing cycles:

After roll coating the make and electrostatically coating abrasive particles the sheet was cured at 66° C. for 14 minutes.

After application of the size the coating was cured by raising the temperature to 65° C. and maintaining that temperature for about 1hour.

Samples 16 and 17 exhibited delamination resistance, whereas the uncoated paper (Sample 18) exhibited significant delamination, indicating EMA, EAA are also suitable polymers for this invention.

We claim:

1. A coated abrasive sheet material comprising:

(a) a backing substrate having top and bottom surfaces comprising paper having a basis weight of less than 150 $g/m^2$ which is essentially free of latex saturants, (b) one or more extruded layers of a thermoplastic polymer bonded to the top surface of said backing substrate, (c) a plurality of abrasive grains, and (d) a binder layer for bonding said plurality of abrasive grains to said one or more extruded layers of a thermoplastic polymer.

2. A coated abrasive sheet material as claimed in claim 1 in which the paper has a basis weight of less than 120 $g/m^2$.

3. A coated abrasive sheet material as claimed in claim 1 in which the thermoplastic polymer is selected from ethylene/butyl acrylate copolymer, ethylene/methyl acrylate copolymer, ethylene/acrylic acid copolymer, low density polyethylene, or combinations thereof.

4. A coated abrasive sheet material as claimed in claim 3 in which the polymer is a copolymer of ethylene and butyl acrylate.

5. A coated abrasive sheet material as claimed in claim 1 in which the surface of the paper is coated with co-extruded layers of low density polyethylene and ethylene/butyl acrylate copolymer.

6. A coated abrasive sheet material as claimed in claim 1 in which the coating weight of the thermoplastic polymer is from 10 to 50 $g/m^2$.

7. A coated abrasive sheet material as claimed in claim 1 in which the coating weight of the thermoplastic polymer is from 20 to 35 $g/m^2$.

8. A coated abrasive sheet material as claimed in claim 1 in which the coating weight of the extruded thermoplastic polymer is from 25 to 30 $g/m^2$.

9. A coated abrasive sheet material as claimed in claim 1 in which the thermoplastic polymer is pigmented.

10. A coated abrasive sheet material as claimed in claim 1 in which the paper contains less than 3% by weight of latex saturants.

11. A coated abrasive sheet material as claimed in claim 1 in which the paper is free of latex saturants.

12. A method of making a coated abrasive sheet material which comprises the steps of providing a paper having a basis weight of less than 150 $g/m^2$ which is essentially free of latex saturant, extruding one or more layers of a thermoplastic polymer over a surface of said paper and coating an abrasive medium comprising abrasive grains embedded in a binder directly onto the thermoplastic polymer.

13. A method as claimed in claim 12 in which the coated material is heated to a temperature above the softening point of the thermoplastic polymer for a period of at least 5 minutes.

14. A method as claimed in claim 12 in which the paper has a basis weight of less than 120 $g/m^2$.

15. A method as claimed in claim 12 in which the thermoplastic polymer is selected from ethylene/butyl acrylate copolymer, ethylene/methyl acrylate copolymer, ethylene/acrylic acid copolymer, low density polyethylene, or combinations thereof.

16. A method as claimed in claim 12 in which the polymer is a copolymer of ethylene and butyl acrylate.

17. A method as claimed in claim 12 in which the surface of the paper is coated with co-extruded layers of low density polyethylene and ethylene/butyl acrylate copolymer.

18. A method as claimed in claim 12 in which the coating weight of the thermoplastic polymer is from 10 to 50 $g/m^2$.

19. A method as claimed in claim 12 in which the coating weight of the thermoplastic polymer is from 20 to 35 $g/m^2$.

20. A method as claimed in claim 12 in which the coating weight of the extruded thermoplastic polymer is from 25 to 30 $g/m^2$.

21. A method as claimed in claim 12 in which the thermoplastic polymer is pigmented.

22. A method as claimed in claim 12 in which the paper contains less than 3% by weight of latex saturants.

23. A method as claimed in claim 12 in which the paper is free of latex saturants.

* * * * *

UNITED STATES PATENT AND TRADEMARK OFFICE

CERTIFICATE OF CORRECTION

PATENT NO. : 5,984,989
DATED : November 16, 1999
INVENTOR(S) : Nigel Davison and Andrew J. Ball It is certified that error appears in the above-identified patent and that said Letters Patent is hereby corrected as shown below:

Title page,
FOREIGN PATENT DOCUMENTS, insert -- WO 95/13164 --.

Column 3,
Line 19, after "flexibility", insert -- manifested as --.

Column 8,
Lines 13 and 14, "1supe-rior" should read -- 1 superior--.

Column 10,
Line 63, "66°'C." should read -- 66°C. --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*